United States Patent [19]

Abe

[11] Patent Number: 4,651,532

[45] Date of Patent: Mar. 24, 1987

[54] METHOD OF WARMING UP A REHEAT TURBINE

[75] Inventor: Shoji Abe, Hitachi, Japan

[73] Assignee: Hitachi, Ltd., Tokyo, Japan

[21] Appl. No.: 850,672

[22] Filed: Apr. 11, 1986

[30] Foreign Application Priority Data

Apr. 12, 1985 [JP] Japan ..... 60-76475

[51] Int. Cl.[4] ..... F01K 13/02

[52] U.S. Cl. ..... 60/646

[58] Field of Search ..... 60/646, 657

[56] References Cited

U.S. PATENT DOCUMENTS 4,226,086 10/1980 Binstock et al. ..... 60/646 X 4,584,836 4/1986 McClelland ..... 60/646

*Primary Examiner*—Allen M. Ostrager

*Attorney, Agent, or Firm*—Antonelli, Terry & Wands

[57] ABSTRACT

In a reheat turbine employing an intermediate pressure steam turbine starting system, a former stage (10*a*) of a high pressure steam turbine (10) is warmed up by a high temperature steam during the starting of an intermediate pressure steam turbine (50) while a latter stage (10*b*) of the high pressure steam turbine (10) is kept in vacuum. The high temperature steam is introduced through a warm-up steam valve (75) branched off from a steam pipe (43) for steam inflowing into an intermediate pressure turbine steam chamber (29). The high temperature steam that has warmed up several stages reaches a latter stage (10*b*) and is discharged into a condenser (54) through a ventilation valve (85) and a steam pipe (87). The former stage (10*a*) is positively warmed up by the high temperature steam to reduce the mismatch quantity. The high pressure steam turbine (10) is maintained warming up by the high temperature steam and cooling by vacuum during the start of the intermediate pressure steam turbine (50).

8 Claims, 6 Drawing Figures

METHOD OF WARMING UP A REHEAT TURBINE

BACKGROUND OF THE INVENTION:

1. Field of the Invention

The present invention relates to a method of warming up a reheat turbine, and more particularly to a method of warming up a high pressure steam turbine in a reheat turbine which is equipped with a high pressure steam turbine and an intermediate pressure steam turbine and employs an intermediate pressure steam turbine starting system.

2. Description of the Prior Art

In conventional reheat turbines employing an intermediate pressure steam turbine starting system, an intermediate pressure steam turbine is started under the state where the interior of a high pressure steam turbine is kept in vacuum. After a predetermined transfer load is attained (that is, after an inlet steam flow regulating valve of the intermediate pressure steam turbine is fully opened), a rated load is reached by opening gradually a steam flow regulating valve of the high pressure steam turbine.

The inflow steam quantity to the high pressure steam turbine is limited in order to prevent a drastic increase of a rotor thermal stress resulting from the difference (a mismatch quantity) between a low temperature steam turbine metal temperature rotating in vacuum and a high pressure steam temperature that flows into the high pressure steam turbine.

The mismatch quantity will be explained with reference to FIG. 4. At the start of the intermediate pressure steam turbine, a mismatch quantity $t_1$ is generated between the metal temperature $T_{m1}$ of the reheat steam chamber and the temperature $T_{s1}$ of the inflow steam in the reheat steam chamber as shown in the curves A and B, respectively. A necessary time till the ventilation of the high pressure steam turbine is determined so that the thermal stress generated thereby is below an allowable value.

As described already, it is necessary for the metal temperature to follow rapidly the steam temperature with a greater mismatch quantity, and at the same time, the speed as well as the load must be raised in the course of a long period. This exactly holds true of the start of the high pressure steam turbine.

The steam temperature at the high pressure first stage of the inflow steam at the time of the start of the high pressure steam turbine is hereby called $T_{s2}$ as shown in curve C. In accordance with the conventional technique, the metal temperature $T_{m2}'$ at the high pressure first stage as shown in curve E is the same temperature as the temperature before the start of the intermediate pressure steam turbine because no warm-up is made at all. Therefore, the mismatch quantity at the high pressure first stage at the time of ventilation of the high pressure steam turbine is $\Delta t_2'$ as shown in FIG. 4.

The above method of warming up the reheat turbine employing the intermediate pressure steam turbine starting steam by utilizing the intercept bypass valve relatively speeds up the timing of opening the steam flow regulating valve at the inlet of the high pressure steam turbine and shortens the start time.

However this conventional method does not take into consideration any measures for improving the mismatch quantity described above, and hence is not free from the problem that the high pressure steam turbine cannot be sufficiently protected from the adverse influence of the thermal stress.

On the other hand, for example, in Japanese Patent Publication No. 2483/1985, a conventional method of warming up a reheat turbine employing an intermediate pressure steam starting system is proposed.

According to above conventional method of warming up a reheat turbine, an intermediate pressure steam turbine provides an intercept bypass valve for regulating flow steam having a small diameter thereon in addition to an inlet steam flow regulating valve. The intercept bypass valve for regulating flow steam is opened before the start of the intermediate pressure steam turbine, and after a predetermined tranfer load is attained, an another steam flow regulating valve at a high pressure steam turbine inlet is opened and the high pressure steam turbine is then started.

SUMMARY OF THE INVENTION

An object of the present invention is to provide a method of warming up a reheat turbine employing an intermediate pressure steam turbine starting system wherein theremal stress of a high pressure steam turbine rotor can be mitigated and thus turbine starting time can be shortened.

A method of warming up a reheat turbine equipped with a high pressure steam turbine and an intermediate pressure steam turbine employs first the intermediate pressure steam turbine and thereafter the high pressure steam turbine starting system.

For this purpose of the present invention, a former stage group of the high pressure steam turbine is warmed up by a high temperature steam during the starting of the intermediate pressure steam turbine while a latter stage group of the high pressure steam turbine is kept in vacuum.

The method of warming up a reheat turbine of the present invention is to warm up a former stage group of a high pressure steam turbine by a high temperature steam from outside during the start of the intermediate pressure steam turbine in order to improve a mismatch quantity and to mitigate thermal stress, and discharges this warm-up steam outside the high pressure steam turbine lest it reaches a latter stage group that is rotating in vacuum.

During the start of the intermediate pressure steam turbine, the high pressure steam turbine is not rotated by the thermal energy of the inflow steam but merely rotates idly so that a mechanical loss (windage loss) occurs due to friction with environmental gas surrounding the turbine rotor.

It is known empirically that the quantity of the windage loss generated by movable blades of the steam turbine is proportional to the specific weight of gas surrounding them, to the about 1.5th power of the blade length and to about the fourth power of the pitch circle diameter of the movable blades at the same number of revolution.

The quantity of the windage loss of the high pressure steam turbine in a standard reheat turbine generated by the movable blade of the last stage which has the longest blade and a large pitch circle diameter is about five times that of the movable blade at the first stage which has the shortest blade and a small pitch circle diameter.

From the aspect of design, on the other hand, the highest temperature of the movable blade at the final stage must be to be the steam temperature at a rated load. However, there frequently occurs such as phenomenon in which the steam does not flow in for some reason or other to cause idling of the high pressure steam turbine, the temperature becomes by far higher than the highest design temperature described above due to the resulting windage loss and the high pressure steam turbine is eventually over-heated.

To reduce such a windage loss, the final stage and stages close to the final stage of the high pressure steam turbine must be kept in vacuum. In contrast, the windage loss generated by a former stage group including a first stage having a short blade and a small pitch circle diameter is not much great as to over-heat the high pressure steam turbine.

As described above, the method of warming up the reheat turbine of the present invention combines warm-up with cooling by vacuum in the high pressure steam turbine during the start of the intermediate pressure steam turbine.

When the former stage group including first stage of the high pressure steam turbine is kept in vacuum state, the former stage group is apt to maintain at low temperature. Therefore, the present invention positively warms up the former stage group including the first stage in the high pressure steam turbine rather than keeps it in vacuum in order to reduce the mismatch quantity.

The contradictory requirements of cooling by vacuum and warm-up by pressurisation (increase at pressure through inflow steam) can be fulfilled by dividing the stages of the high pressure steam turbine into two stage groups, discharging the steam after warm-up of the former stage group outside the high pressure steam turbine by vacuum at the branch point and preventing it from flowing into the latter stage group of the high pressure steam turbine.

The present invention can mitigate the thermal stress of the turbine rotor and can simultaneously shorten the necessary time for the turbine start at the time of starting the high pressure steam turbine. Therefore, the present invention is effective in improving the performance and durability of the steam turbine, and can save the fuel consumption during the operation and various auxiliary mechanical force.

DETAILED DESCRIPTION OF THE PREFERRED EMBODIMENTS

Figure 1:
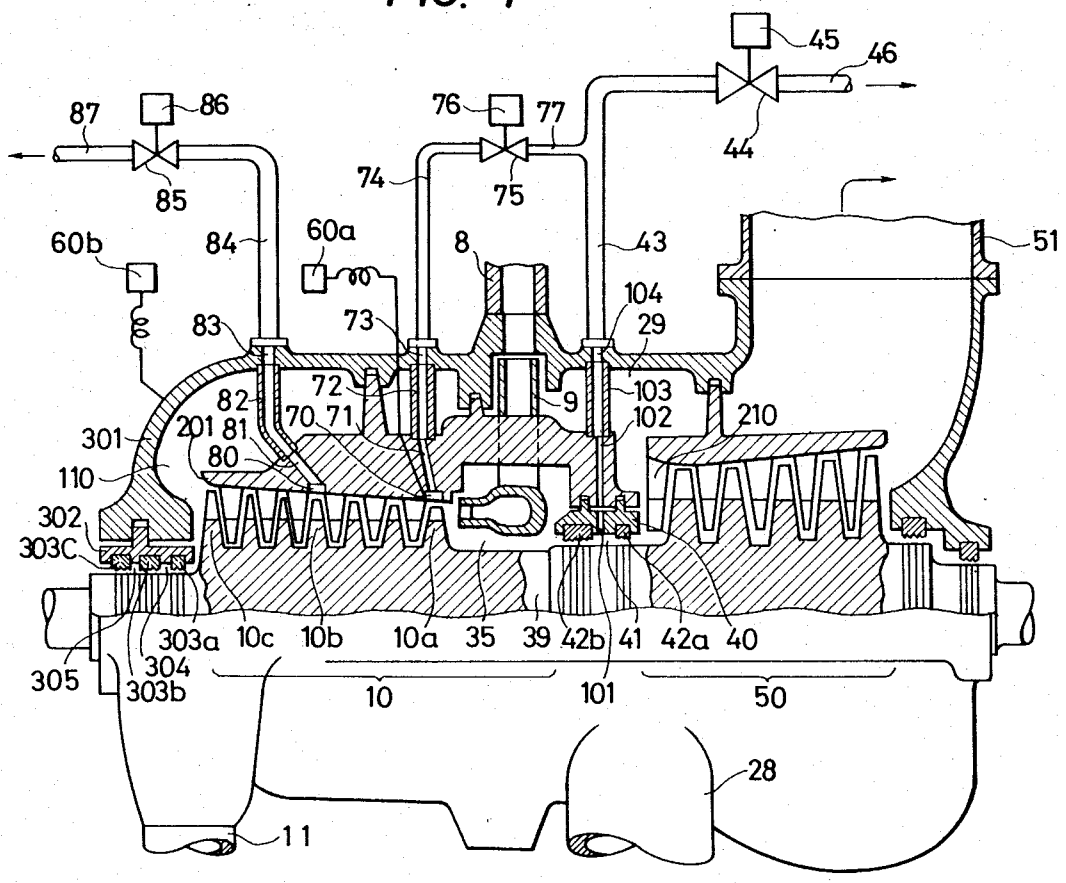
FIG. 1 is a sectional view an embodiment of an apparatus of a reheat turbine portion to which the present invention is applied.
Figure 2:
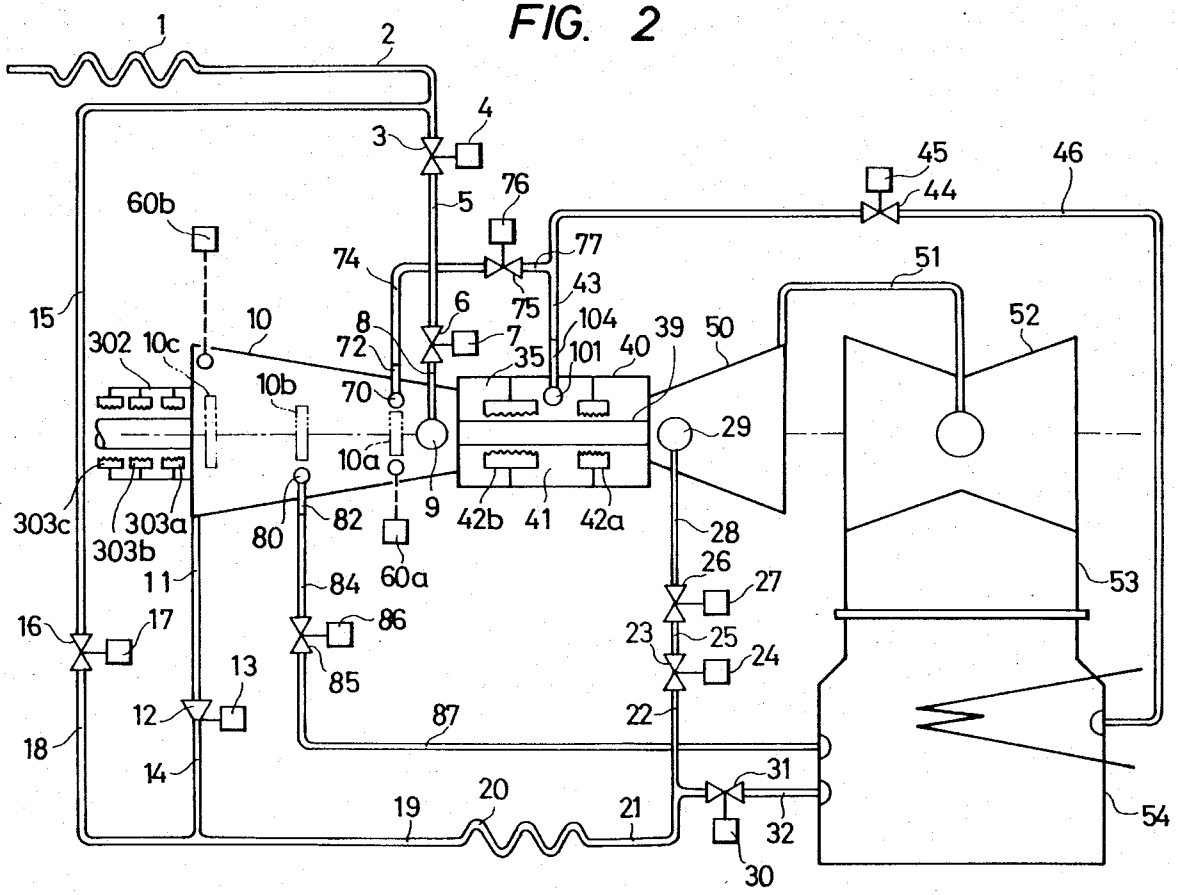
FIG. 2 is a schematic view of the relation between the apparatus of a reheat turbine portion and an overall system diagram.

A preferred embodiment of the present invention will be described with reference to the accompanying drawings. FIG. 1 illustrates a typical embodiment of the present invention, and FIG. 2 shows an overall system diagram including the embodiment shown in FIG. 1.

A steam generated in a superheater 1 leads to a high pressure steam turbine 10 through a main steam pipe 2, a main steam stop valve or an emergency shut off valve 3 having a hydraulic cylinder 4, a steam pipe 5, a high pressure steam flow regulating valve 6 having a hydraulic cylinder 7, a steam pipe 8 and an inlet port 9.

The construction of the turbine bypass apparatus will be explained below. The steam generated in the superheater 1 leads to a reheater 20 through the main steam pipe 2, a steam pipe 15, a bypass steam flow regulating valve 16 having a hydraulic cylinder 17, a steam pipe 18 and a steam pipe 19.

A non-return valve 12 having a valve actuator 13 is connected to an exhaust pipe 11 of the high pressure steam turbine 10. The non-return valve 12 is also connected to between the steam pipe 18 and the steam pipe 19 through a connection pipe 14.

The steam generated in the reheater 20 leads to a condenser 54 through a steam pipe 21, a bypass steam flow control valve 31 having a hydraulic cylinder 30 and a steam pipe 32. The condensated steam in the condenser 54 is sent to over again into the superheater 1 by means of a condensate pump (not shown in drawing).

The steam generated in the reheater 20 leads to an intermediate pressure steam turbine 50 through the steam pipe 21, a steam pipe 22, an emergency shut off valve 23 having a hydraulic cylinder 24, a steam pipe 25, an intermediate pressure steam flow rate regulating valve 26 having a hydraulic cylinder 27, a steam pipe 28 and a reheat steam chamber 29.

A turbine steam inflow valve in the reheat turbine is constructed with the high pressure steam flow control valve 6 for control the high pressure steam inflow from the superheater 1 and the emergency shut off valve 3, and the flow control valve 26 for control the intermediate pressure steam inflow from the reheater 20 and the emergency shut off valve 23.

A steam from an intermediate outlet port 80 of the high pressure steam turbine 10 leads to the condenser 54 through a connection pipe 82, a steam pipe 84, a ventilator valve 85 having a valve actuator 86, and a steam pipe 87.

The intermediate pressure steam turbine 50 and the low pressure steam turbine 52 become a body of rotation as one by means of a shaft coupling, and then drive the high pressure steam turbine 10 at a same rotation speed.

When the intermediate pressure steam flow control valve 26 opens, the steam rotates the intermediate pressure steam turbine 50 through the steam pipe 28. The steam which is performed work done in the intermediate pressure steam turbine 50 leads to the low pressure steam turbine 52 through a communication pipe 51 and continue to be expanded therein, and thereafter leads to the condenser 54 through a low pressure steam turbine exhaust chamber 53.

In FIG. 1, the major proportion of the steam flowing into an intermediate pressure steam turbine chamber or reheat steam chamber 29 reaches the low pressure steam turbine 52 through the communication pipe 51 while expanding inside an intermediate pressure steam turbine stage.

Part of the steam passes through the gap between a stationary blade 210 of an initial stage of the intermediate pressure steam turbine 50 and a packing case 40 and also the gap between a labyrinth packing 42*a* and a turbine rotor 39, and reaches a steam chamber 41. Part of the steam reaches a warm-up steam valve 75 through a hole 101 formed on the packing case 40, a hole 102 formed in a high pressure internal wheel chamber 201, a communication pipe 103, a hole 104 formed in an external wheel chamber 301, a steam pipe 43 and a steam pipe 77.

Since a blow-down valve 44 is fully closed, when the warm-up steam valve 75 is suitably opened, the steam passes through a steam pipe 74, a hole 73 formed in the external wheel chamber 301, a communication pipe 72, a hole 71 formed in the high pressure internal wheel chamber 201 and a groove 70 formed on the circumference on the inner surface of the internal wheel chamber 201, and reaches a high pressure first stage 10*a* of the high pressure steam turbine 10. Thus, the steam that has warmed up several stages reaches a latter stage 10*b* and is discharged into the condenser 54, which is kept in vacuum, through a ventilator valve 85 that is fully open and a steam pipe 87.

The labyrinth packing 42*a* is designed so that the number of its teeth is smaller than that of the labyrinth packing 42*b*. This is to reduce the steam quantity flowing out to the steam chamber 35 through the labyrinth packing 42*b* and to use a greater quantity of steam as the warm-up steam as much.

On the other hand, the labyrinth packings 303*a*, 303*b* and 303*c* are disposed on the packing case 302 in order to prevent the high pressure steam from leaking outside the high pressure steam turbine 10 in an operation at a normal load, but they play the role of preventing external air from flowing into the high pressure steam turbine 10, which is in vacuum at the start of the intermediate pressure steam turbine 50, on the contrary. Therefore, a seal steam controlled to a predetermined pressure (about 1.3 ata) a little bit higher than the atmospheric pressure is supplied into a steam chamber 304.

This steam flows partly into the high pressure steam turbine 10 through the labyrinth packing 303*a* and partly into a steam chamber 305 through the labyrinth packing 303*b*. This steam chamber 305 is connected to a gland steam exhauster (not shown) controlled to a predetermined pressure (about 1.02 ata) a little bit lower than the atmospheric pressure. The air in the atmosphere passes through the labyrinth packing 303*c* and reaches a space, and is thereafter discharged into the gland steam exhauster together with the steam described above.

In conjunction with the flows of the steam described above, the relation $Q_3=Q_1+Q_2$ is established where $Q_1$ is the flow rate of the warm-up steam from the reheating steam chamber 29 to the latter stage 10*b*, $Q_2$ is the flow rate of the seal steam flowing into the high pressure steam turbine 10 through the labyrinth packing 303*a*, and $Q_3$ is the flow rate of the steam discharged from the latter stage 10*b* into the condenser 54 through the ventilator valve 85.

According to the calculation made by the present inventor, the degree of vacuum at the stage 10*b* that satisfies the relation described above somewhat drops in comparison with the value in the condenser 54 but is practically sufficient to reduce the windage loss of the latter stage group (with the ratio $Q_1/Q_2$ being about 10). Since a sufficient space is secured between the stages 10*b* and 10*c* and pressure loss due to throttling can be almost neglected, these stages 10*b* and 10*c* are kept at substantially the same vacuum.

A thermo-couple 60*a* is disposed on the inner wall of the high pressure internal wheel chamber 201 which is the closest to the high pressure first stage 10*a* and simulates the warm-up effect of the first stage 10*a* by measuring the temperature of the internal wheel chamber 201. Since the degree of vacuum of the latter stage group 10*b* will be spoiled by excessive warm-up steam. Another thermo-couple 60*b* is disposed in order to sense this change as a temperature rise of the exhaust chamber 110 of the high pressure steam turbine 10 generated by the windage loss.

Next, each operating condition of the reheat turbine and the open/close operation of each valve will be described with reference to FIG. 3. When an emergency trip system of the reheat turbine is reset, the emergency trip valve 3 for the high pressure steam turbine 10 and the emergency trip valve 23 for the intermediate pressure steam turbine 50 are opened fully. At the same time, the warm-up steam valve 75 is opened fully.

When the inflow steam temperature of the intermediate steam turbine 50 reaches a value at which its difference (mismatch quantity) is in the allowable range with respect to the metal temperature of the reheat steam chamber 29, the intermediate pressure steam flow regulating valve 26 starts to open and at the same time, the blow-down valve 44 is fully closed. This is to prevent the warm-up steam introduced into the steam pipe 43 fom being discharged into the condenser 54 through the blow-down valve 44.

When the intermediate pressure steam flow regulating valve 26 opens, the intermediate pressure steam turbine 50 increases speed to a rated speed. After a rated speed is attained, a generator connected directly to the steam turbine is synchronized and a predetermined transfer load is applied thereto. The time required from the steam turbine start up to this point is determined by the mismatch quantity at the reheat steam chamber 29.

For example, when the steam temperature is higher than the metal temperature, the warm-up of the metal temperature is promoted by extending the necessary time with a greater mismatch quantity in order to reduce the difference with the steam temperature and to limit the thermal stress of the metal within an allowable range.

Then, the intermediate pressure steam flow regulating valve 26 is opened fully, the high pressure steam flow regulating valve 6 starts opening to secure a load and steam admission to the high pressure steam turbine 10 is commenced. At this time, the warm-up steam valve 75 and the ventilator valve 85 finish their roles and both the warm-up steam valve 75 and the ventilator valve 85 are fully closed.

When the turbine trips for some reason or other during the operating at a rated load or due to windage loss, the reheat turbine will be over-heated due to the windage loss. In order to prevent this problem, the ventilator valve 85 is again opened fully and communicates the high pressure steam turbine 10 to the condenser 54. Since the intermediate pressure steam turbine 50 is connected to the condenser 54 through the low pressure steam turbine 52, such a measure is not necessary.

The blow-down valve 44 extracts, at an intermediate portion of the labyrinth packings 42*a* and 42*b*, the residual steam sealed in the high pressure steam turbine 10 to prevent it from flowing into the intermediate pressure steam turbine 50 through the laybrinth packings 42*b*, 42*a* and from accelerating the intermediate pressure steam turbine 50 and the low pressure steam turbine 52, and discharges this steam into the condenser 54. For this reason, the blow-down valve 44 is again opened fully. The warm-up steam valve 75 is also opened again fully in order to promote the roles of the ventilator valve 85 and the blow-down valve 44 described above.

Figure 4:
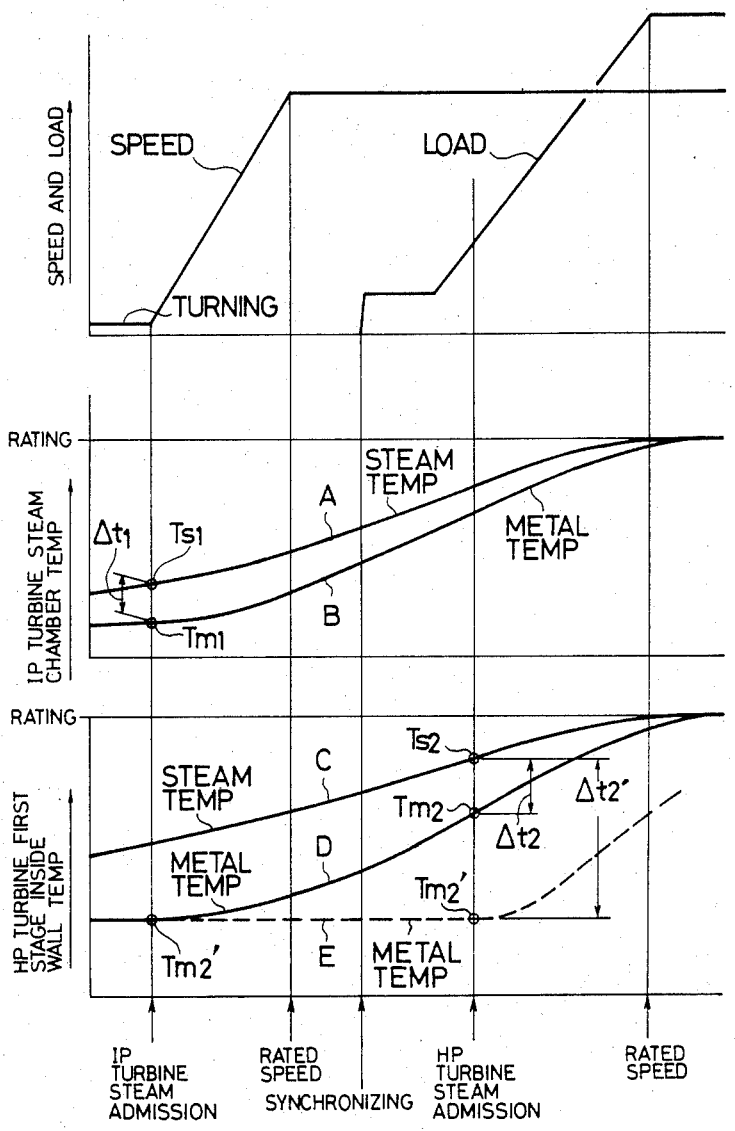
FIG. 4 is a diagram of a mismatch quantity in the present invention in comparison with a mismatch quantity in the prior art technique.

Next, the effect of the present invention in conjunction with the effect of the warm-up steam valve 75 and the mismatch quantity will be described with reference to FIG. 4.

As stated in the background of the invention in accordance with the conventional technique, the metal temperature $T_{m2}'$ at the high pressure first stage is the same temperature as the temperature before the start of the intermediate pressure steam turbine because no warm-up is made at all. The mismatch quantity at the high pressure first stage at the time of ventilation of the high pressure steam turbine is $\Delta t_2'$.

On the other hand, in accordance with the present invention, the warm-up steam valve 75 causes the warm-up steam to flow into the high pressure steam turbine 10 at the start of the intermediate pressure steam turbine 50 so that the metal temperature at the high pressure first stage is raised to $T_{m2}$ as shown in curve D. The mismatch quantity at this time is $\Delta t_2$ and obviously the relation $\Delta t_2 < \Delta t_2'$ is established as shown in FIG. 4. Accordingly, the necessary time till the rated load is determined by the smaller $\Delta t_2$ value, and the rated load can be reached by a shorter necessary time than the conventional technique.

Figure 5:
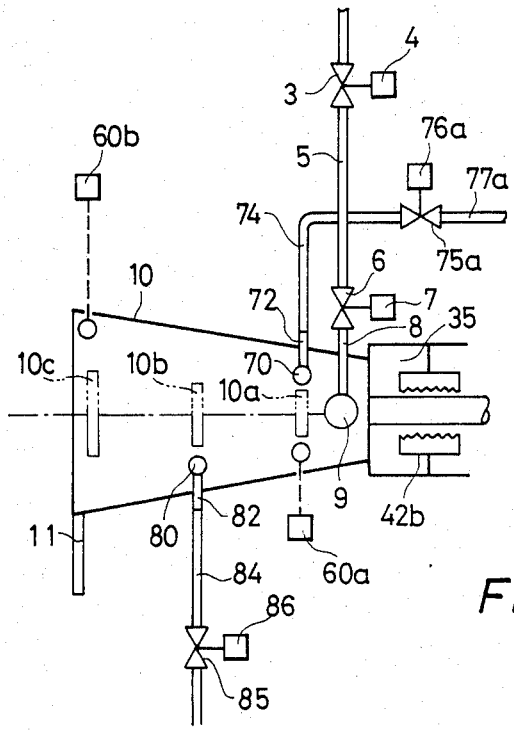
FIGS. 5 and 6 are schematic views of another embodiments of the apparatus of a reheat turbine portion, respectively.

Another embodiments of the method of warming up a reheat turbine will be explained with reference to FIGS. 5 and 6. It is not particularly necessary to use a part of the inflow steam to the intermediate pressure steam turbine 50 as shown in FIG. 1 provided that the warm-up steam has optimal pressure and temperature.

It is therefore possible to use a steam from outside the turbine such as an auxiliary steam as the warm-up steam. In FIG. 5, the auxiliary steam is used as the warm-up steam through a steam pipe 77*a*, and a warm-up steam valve 75*a* having a valve actuator 76*a*.

Figure 6:
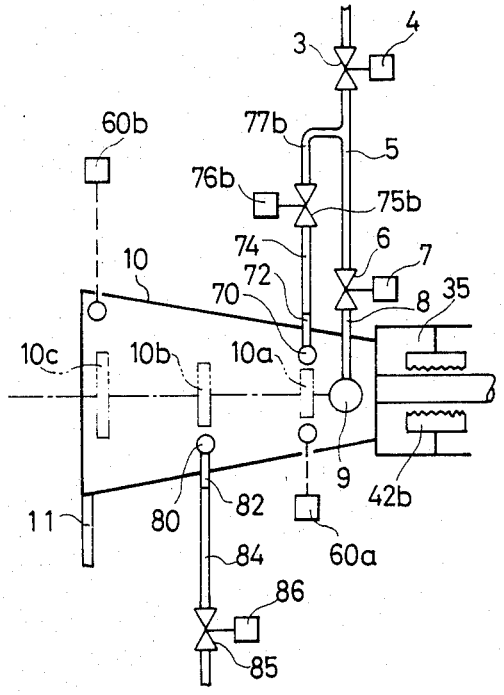

FIG. 6 shows an another embodiment of the present invention wherein the steam downstream of the emergency shut off valve 3 of the high pressure steam turbine 10 that is fully opened by turbine reset (with the high pressure steam flow regulating valve 6 being closed fully at this time) bypasses the high pressure steam regulating valve 6 and is used as the warm-up steam.

The warm-up steam is branched off from the steam pipe 5 and introduced to the groove 70 through a steam pipe 77*b*, a warm-up steam valve 75*b* having a valve actuator 76*b*, the steam pipe 74 and the connection pipe 72.

Figure 3:
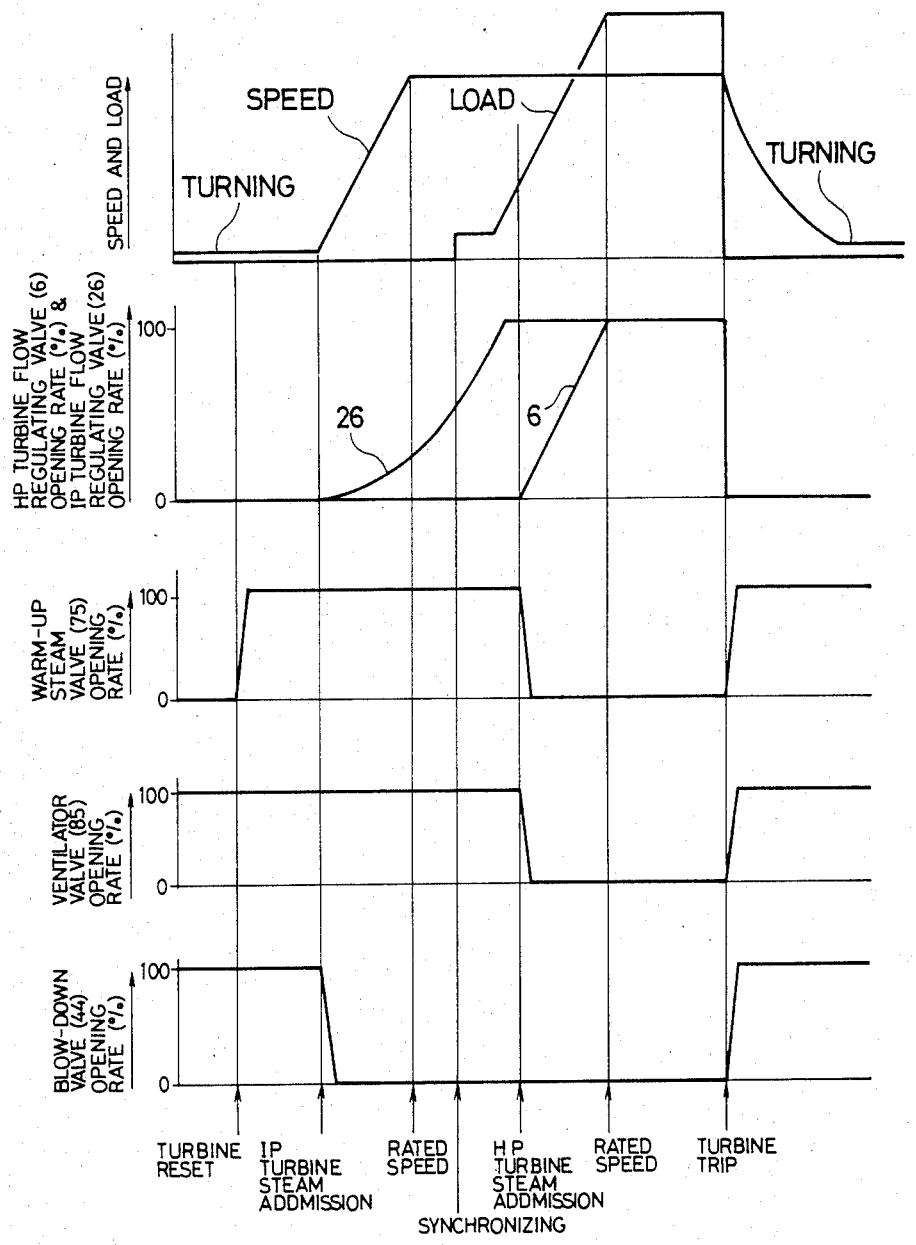
FIG. 3 is a diaghram of the open/close state of each valve associated with the start/stop of the steam turbine of the present invention.

In either cases, the open/close relation between the warm-up steam valve 75*a* or 75*b* and the other valves is supposed to have the characteristics shown in FIG. 3.

What is claims is:

1. A method of warming up a reheat turbine equipped with a high pressure steam turbine (10) and an intermediate pressure steam turbine (50) employing first said intermediate pressure steam turbine (50) and thereafter said high pressure steam turbine (10) starting system characterized in that a former stage group (10*a*) of said high pressure steam turbine (10) is warmed up by a high temperature steam during the starting of said intermediate pressure steam turbine (50) while a latter stage group (10*b*) of said high pressure steam turbine (10) is kept in vacuum.

2. A method of warming up a reheat turbine according to claim 1 characterized in that said high temperature steam for warming up said former stage group (10*a*) is discharged outside said high pressure steam turbine (10) before it reaches said latter stage group (10*b*).

3. A method of warming up a reheat turbine according to claim 1 characterized in that said high temperature steam for warming up said former stage group (10*a*) of said high pressure steam turbine (10) is introduced before and/or simultaneously with the start of said intermediate pressure steam turbine (50), and the introduction of said high temperature steam is stopped before the start of said high pressure steam turbine (10).

4. A method of warming up a reheat turbine according to claim 1 characterized in that said high temperature steam for warm-up is extracted from between a blow-down valve (44) and an intermediate labyrinth packing (42*b*; 42*a*).

5. A method of warming up a reheat turbine according to claim 1 characterized in that said high temperature steam for warm-up is supplied from a reheat steam at the inlet of said intermediate pressure steam turbine (50).

6. A method of warming up a reheat turbine according to claim 1 characterized in that a steam having optimal pressure and temperature is supplied from outside said reheat turbine as said steam for warm-up.

7. A method of warming up a reheat turbine according to claim 1 characterized in that said high temperature steam for warm-up is supplied from a main steam at the inlet of said high pressure steam turbine (10).

8. A method of warming up a reheat turbine equipped with a high pressure steam turbine (10) and an intermediate pressure steam turbine (50) employing first said intermediate pressure steam turbine (50) and thereafter said high pressure steam turbine (10) starting system characterized in that a former stage group (10*a*) of said high pressure steam turbine (10) is warmed up by a high temperature steam during the starting of said intermediate pressure steam turbine (50), said high temperature steam is introduced through a warm-up steam valve (75) branched off from a steam pipe (43) for steam inflowing into an intermediate pressure steam turbine chamber (29), while a latter stage group (10*b*) of said high pressure steam turbine (10) is kept in vacuum, and said high temperature steam that has warmed up several stages reaches said latter stage group (10*b*) and is discharged into a condenser (54) through a ventilator valve (85) and a steam pipe (87).

* * * * *